US006317138B1

(12) United States Patent
Yano et al.

(10) Patent No.: US 6,317,138 B1
(45) Date of Patent: Nov. 13, 2001

(54) VIDEO DISPLAY DEVICE

(75) Inventors: Motoyasu Yano; Eizo Okamoto, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/277,187

(22) Filed: Mar. 26, 1999

(30) Foreign Application Priority Data

Mar. 31, 1998 (JP) ..... P10-086605
Jan. 28, 1999 (JP) ..... P11-019929

(51) Int. Cl.[7] ..... G09G 3/32
(52) U.S. Cl. ..... 345/589; 345/83
(58) Field of Search ..... 345/156, 82, 83, 345/511, 521, 520, 428, 589, 601, 602; 348/799, 800, 563

(56) References Cited

U.S. PATENT DOCUMENTS 4,581,655 * 4/1986 Ide et al. ..... 348/798
4,649,432 * 3/1987 Watanabe et al. ..... 348/800
5,010,411 * 4/1991 Shimada et al. ..... 348/799
5,528,257 * 6/1996 Okumura et al. ..... 345/99
5,710,600 * 1/1998 Ishii et al. ..... 348/563

* cited by examiner

*Primary Examiner*—Chanh Nguyen
*Assistant Examiner*—Uchendu O. Anyaso
(74) *Attorney, Agent, or Firm*—Ronald P. Kananen; Rader, Fishman & Grauer

(57) ABSTRACT

A video display device is described, which is capable of easily correcting variations in luminous brightness of each display element. When a video display part is comprised of a plurality of display units including a plurality of display elements, respective correction data for correcting the variations in luminous brightness of the individual display elements are supplied to memory means. When the display elements are driven, the correction data is supplied to their corresponding drivers. In doing so, the display elements can be driven in a corrected state of the variations in luminous brightness. Even when a unit cell comprising display elements is replaced by another and brightness level is re-adjusted, new correction data relative to it is updated. Said updated correction data may simply be stored in the same memory means. Thus, the variations in luminous brightness can be easily corrected even when the unit cell is replaced by another and re-adjusted.

20 Claims, 13 Drawing Sheets

FIG. 4
(RELATED ART)
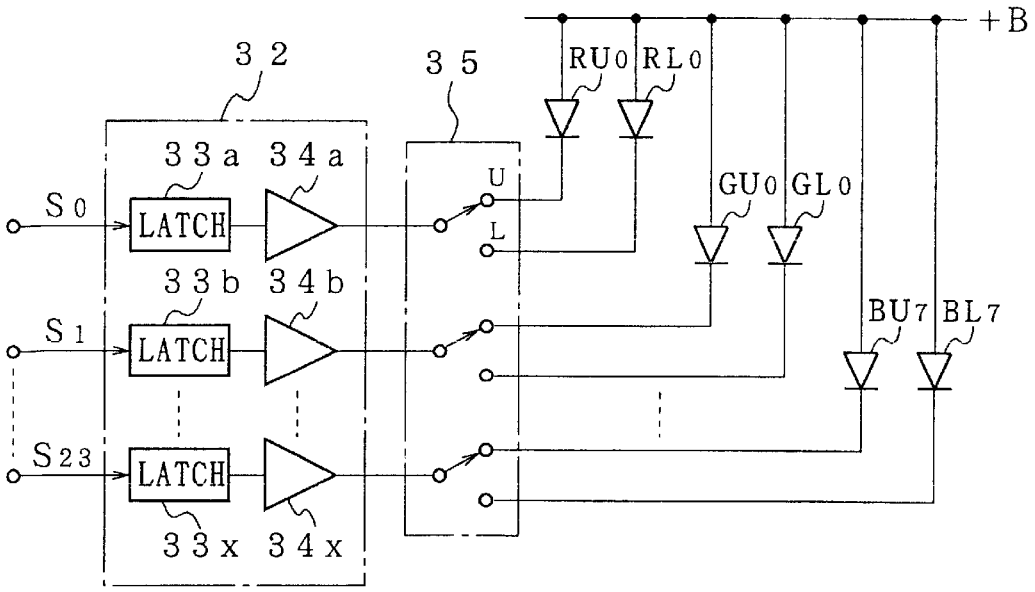
FIG. 5A
(RELATED ART)
FIG. 5B
(RELATED ART)
FIG. 5C
(RELATED ART)
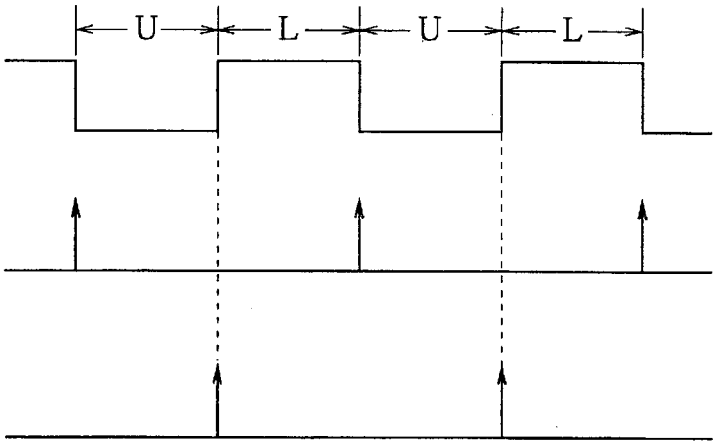

FIG. 8
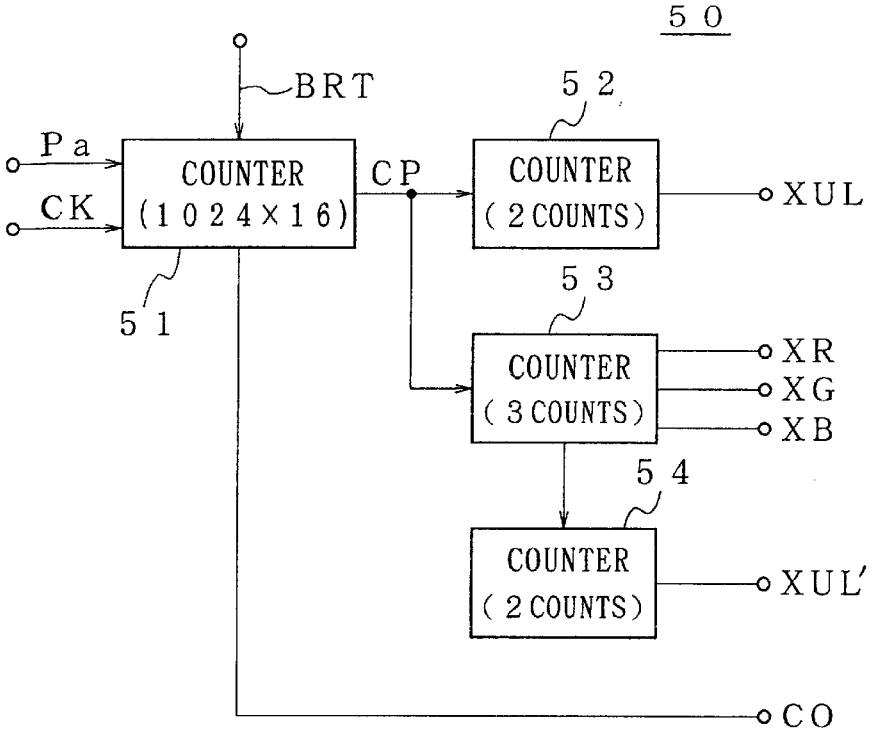
FIG. 9A
FIG. 9B
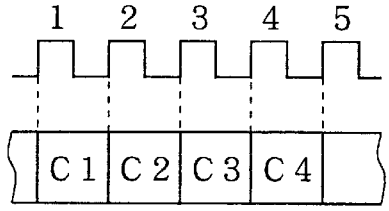
FIG. 10A
FIG. 10B
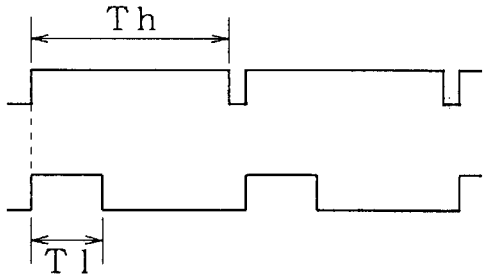

VIDEO DISPLAY DEVICE

BACKGROUND OF THE INVENTION

1. Field of the Invention

The present invention relates to a video display device suitable for application to a large video display device or the like. Specifically, the present invention relates to a video display device wherein a memory stores previously current correction values for correcting variations in luminous brightness of a plurality of display elements constituting a video display part, and the variations in luminous brightness within the video display part can be corrected by driving the display elements through the use of the current correction values read from the memory.

2. Description of Related Art

A large video display device has been set up in a place for doing various events outdoors, an outdoor or indoor stadium, sport facilities, and so forth. The large video display device displays the contents of events, the results of competition, and so forth on a large-sized video display part (i.e., a panel or a screen) thereof.

The video display device for this purpose has a video source (i.e., a VTR or the like) 12, as shown in FIG. 1. The video source 12 transmits video images (the contents of events, the contents of competition, drama programs, and so forth) to a signal processing device 30 where they are converted into signal form suitable for a video display part 14. Thereafter, the signal processing device 30 transmits the converted signal to the video display part 14 and then a desired image or picture is displayed on the video display part 14. The video display part 14 is constructed so as to be suitable for a large screen (e.g., 4m×3m).

The video display part 14 is a collection of a plurality of dots. FIGS. 2A through 2C show an example thereof. In the example, a unit dot (hereinafter called "dot") 16 comprises a trio of display elements, each of which emits light of red R, green G or blue B, as shown in FIG. 2A. The dots 16 are arranged over p rows and q columns (both p and q are four in the illustrated example) to form each individual unit cell 18 (see FIG. 2B). Further, the unit cells are arranged over m rows and n columns (both m and n are four in the illustrated example) to form a display unit 20 as a unit (see FIG. 2C). A large video display part 14 is constructed by a collection of the display units 20.

In such a video display part 14, separate drivers drive respectively the display elements themselves defined as an RGB trio constituting the dot 16 in order to obtain sufficient luminous brightness, for example. The unit cell 18 is normally formed by 16 dots (4×4 dots) and thus forty eight individual drivers drive forty eight display elements (16 dots×3 elements).

Even if each unit cell is represented as 4×4=16 dots as shown in FIG. 3, forty eight drivers corresponding to forty eight display elements cause a drive circuit to increase in size. As means for solving this, means have been proposed for reducing the number of drivers to ½ of the number by providing switching or selector means such that one driver drives two display elements.

FIG. 4 is a fragmentary systematic diagram showing one example of the proposal. When one unit cell consists of forty eight display elements as shown in FIG. 3, a driver circuit 32 is constructed so as to drive twenty-four display elements corresponding to ½ of the forty eight display elements. Thus, the driver circuit (IC driver) 32 comprises latch circuits 33*a* through 33*x* for latching twenty for video data S0 through S23 and drivers 34*a* through 34*x* electrically connected to the latch circuits at their subsequent stages as shown in FIG. 4. Each of the respective drivers 34*a* through 34*x* is respectively connected to their corresponding display elements RU0 through BL7 via switching means 35 and then the driver circuit 32 transmits the outputs of drivers 34*a* through 34*x* to the display elements RU0 through BL7.

In the unit cell as shown in FIG. 3, eight dots of an n row and an n+2 row (i.e., a lower-stage dot group L) are simultaneously driven. Next, eight dots of the remaining n+1 row and n+3 row (lower-stage dot group L) are also simultaneously driven. That is, these dot groups, i.e., display element groups U and L, are alternately driven in a predetermined cycle. Here, each set of the display elements RU0 through RU7, GU0 through GU7 and BU0 through BU7 emits respectively the same light-emitting color. Similarly, each set of the display elements RL0 through RL7, GL0 through GL7 and BL0 through BL7 emits respectively the same light-emitting color.

An example of the alternate driving of the dot groups U and L will be shown in FIGS. 5A through 5C. These figures show the case in which they are alternately switched over plural times (about 16 times) at time intervals (each corresponding to 1/30 second) of individual one frame. During this period of time for one frame, the same video data is supplied to the corresponding display element group.

On the other hand, when the video display part 14 comprises the plurality of display elements, as described above, such as light-emitting diode devices (LEDs) the luminous brightness of each individual element varies, although dissimilar even according to the display element to be used. It is therefore necessary to correct previously current values for driving the display elements so that all the display elements to be used may be kept constant in luminous brightness.

As a current correcting method, adjustment of constants of the drivers for driving display elements is considered. In doing so, however, when a unit cell is replaced by another, the corresponding individual drivers must be re-adjusted so as to provide new current correction values for display elements provided within the replaced unit cell. This becomes so troublesome.

With the foregoing problems in view, it is therefore an object of the present invention to provide a video display device capable of easily setting current correction values for adjusting luminous brightness even when a unit cell is replaced by another.

SUMMARY OF THE INVENTION

According to one aspect of this invention, for achieving the above object, there is provided a video display device comprising a display unit including a unit cell which is comprised of a plurality of dots arranged vertically and horizontally, each dot being comprised of a plurality of display elements; first memory means for storing therein video data to be supplied to the plurality of display elements; and second memory means for storing therein correction data for correcting variations in luminous brightness of each of the display elements; wherein the display elements are driven based on the correction data read from the second memory means.

In the present invention, the correction data (i.e., current correction values) for correcting the variations in luminous brightness of each display element, is stored in the second memory means. When the display elements are driven, they are driven based on the current correction values related to them. Thus, the plurality of display elements emit light at the same brightness level. When the brightness of a specific unit cell is re-adjusted in the case that, for example, the unit cell is replaced by another, the correction data relating to the unit cell is updated. In doing so, the entire brightness of the video display part can be held uniform even when any unit cell is replaced by another.

The display element groups are alternately driven using the same video data of one frame. Further, since the data stored in the first memory means is simply read out as the video data in this case, the video data can be processed at high speed.

Typical ones of various inventions of the present inventions have been shown in brief. However, the various inventions of the present application and specific configurations of these inventions will be understood from the following description.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 4 is a connection diagram illustrating the relationship between drivers and display elements relating to the related art of this invention;

FIGS. 5A through 5C are diagrams showing the relationship between switching timing and reading of data relating to the related art of this invention;

FIG. 8 is a systematic diagram showing a control signal generating circuit;

FIGS. 9A and 9B are respectively diagrams for describing a counter output;

FIGS. 10A and 10B are respectively diagrams for describing brightness control;

DESCRIPTION OF THE PREFERRED EMBODIMENTS

Preferred embodiments of the present invention will herein after be described with reference to the accompanying drawings.

Figure 1:
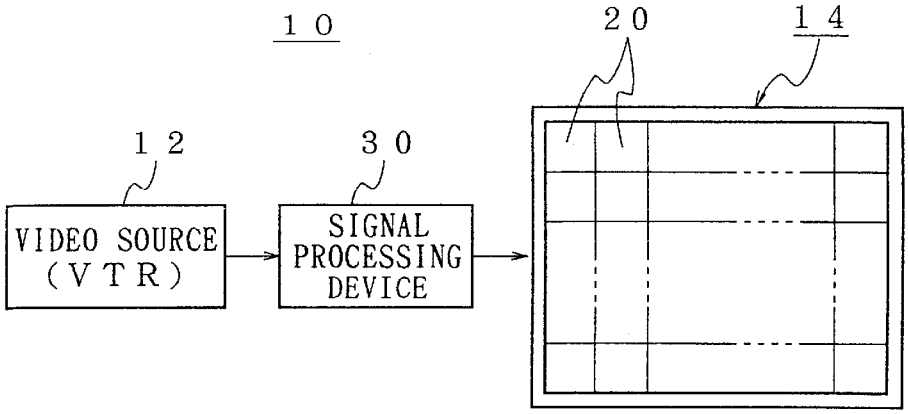
FIG. 1 (RELATED ART)
FIG. 1 is a systematic diagram of a large video display device relating to the related art of this invention.
Figure 3:
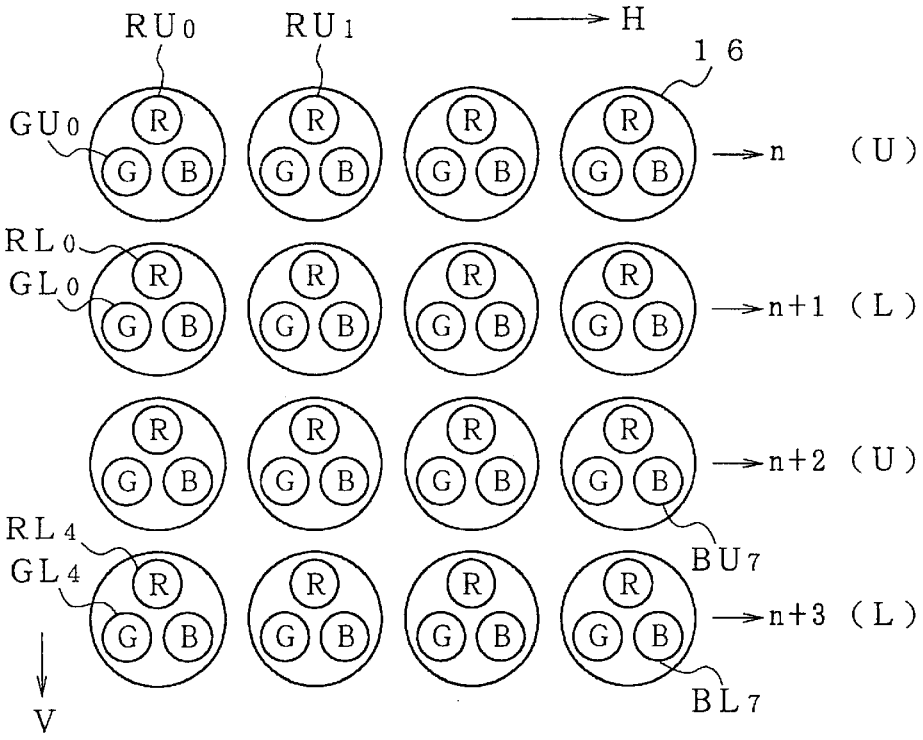
FIG. 3 (RELATED ART)
FIG. 3 is a diagram for describing a unit cell and dots, namely, RGB trios relating to the related art of this invention.
Figure 2A:
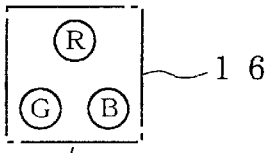
FIGS. 2A through 2C are diagrams showing the relationship between RGB trios, a unit cell and a display unit relating to the related art of this invention.

A preferred embodiment of a video display device according to the present invention, which is applied to the above-described large video display device, will subsequently be explained in detail with reference to the accompanying drawings. Thus, a video display portion, which constitutes the present video display device, is also essentially constructed with RGB trios as one dot 16 in a manner similar to the relevant example shown in FIGS. 2A through 2C. A plurality of the dots are collected and thereby the collected plurality of dots constitute a unit cell 18. Display units 20 each comprised of a collection of the unit cells 18 are arranged longitudinally and latitudinally to constitute a large video display part 14.

Any of an organic light-emitting display element (organic EL), a light-emitting diode element (LED), a discharge tube, and a cathode ray tube (CRT) is used as a display element. The following example makes use of the light-emitting diode element.

Figure 2B:
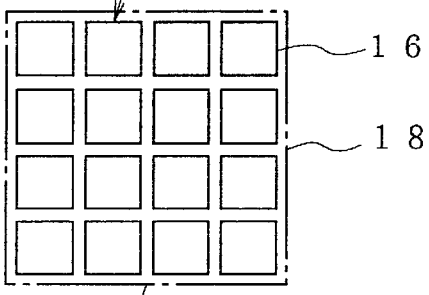
Figure 2C:
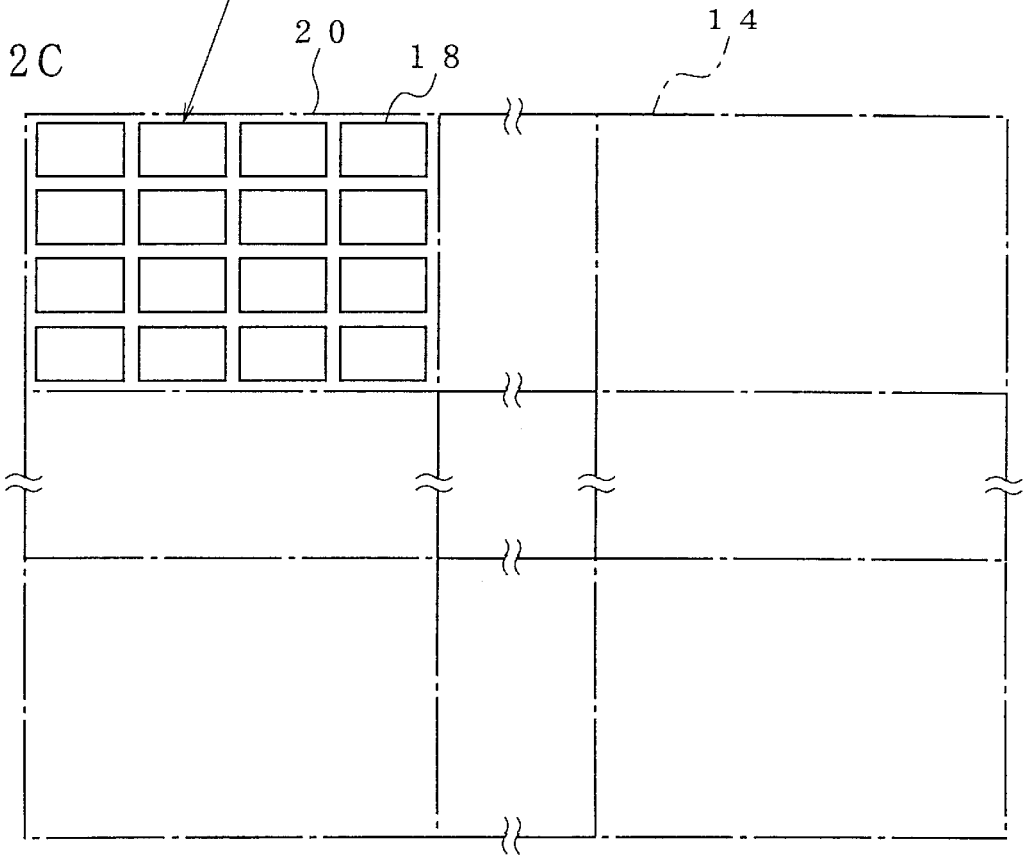
Figure 6:
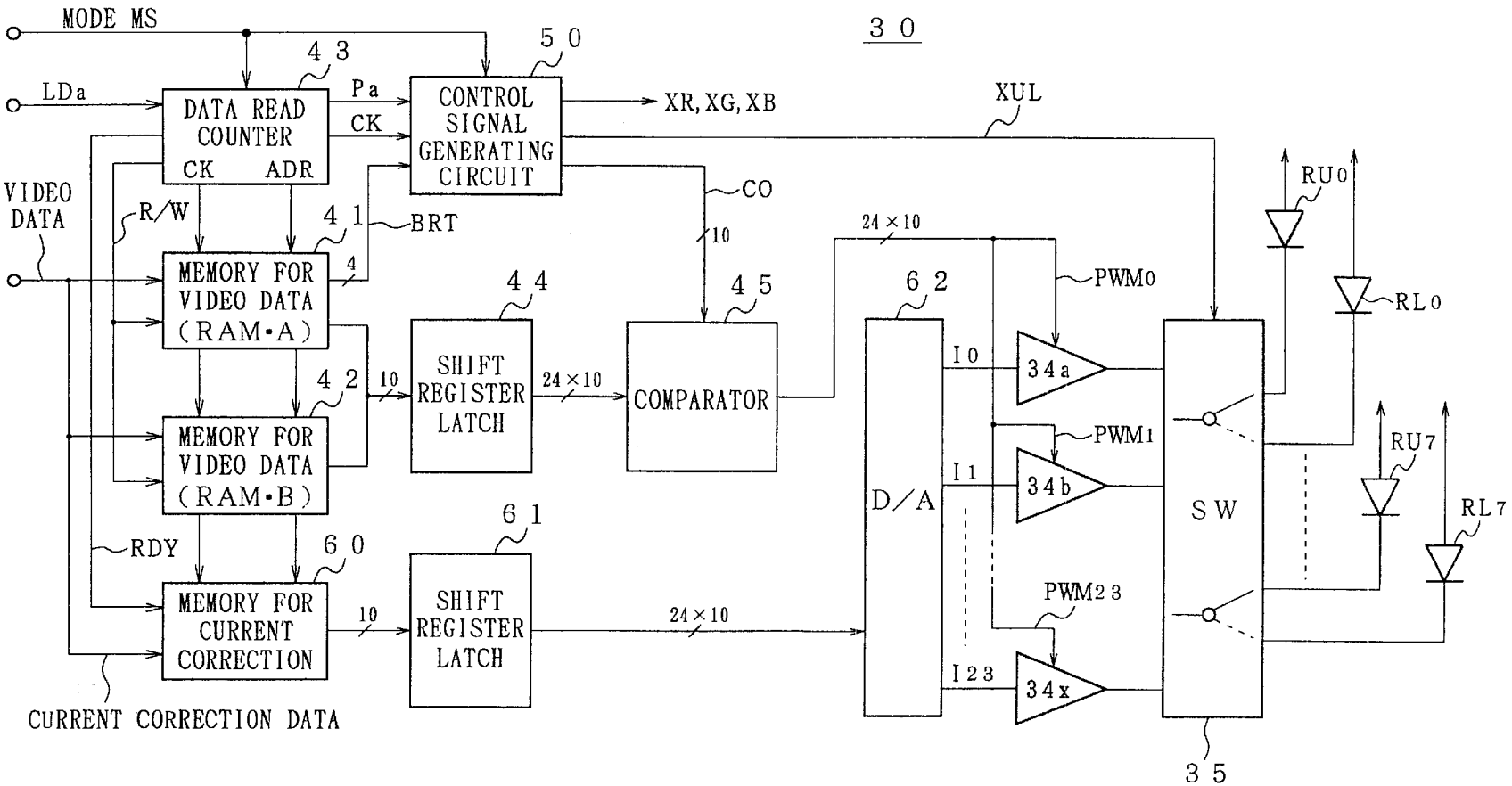
FIG. 6 is a fragmentary systematic diagram showing a signal processing device for one unit cell, which constitutes a video display device as a first embodiment of the present invention.
Figures 7A, 7B, 7C, 7D:
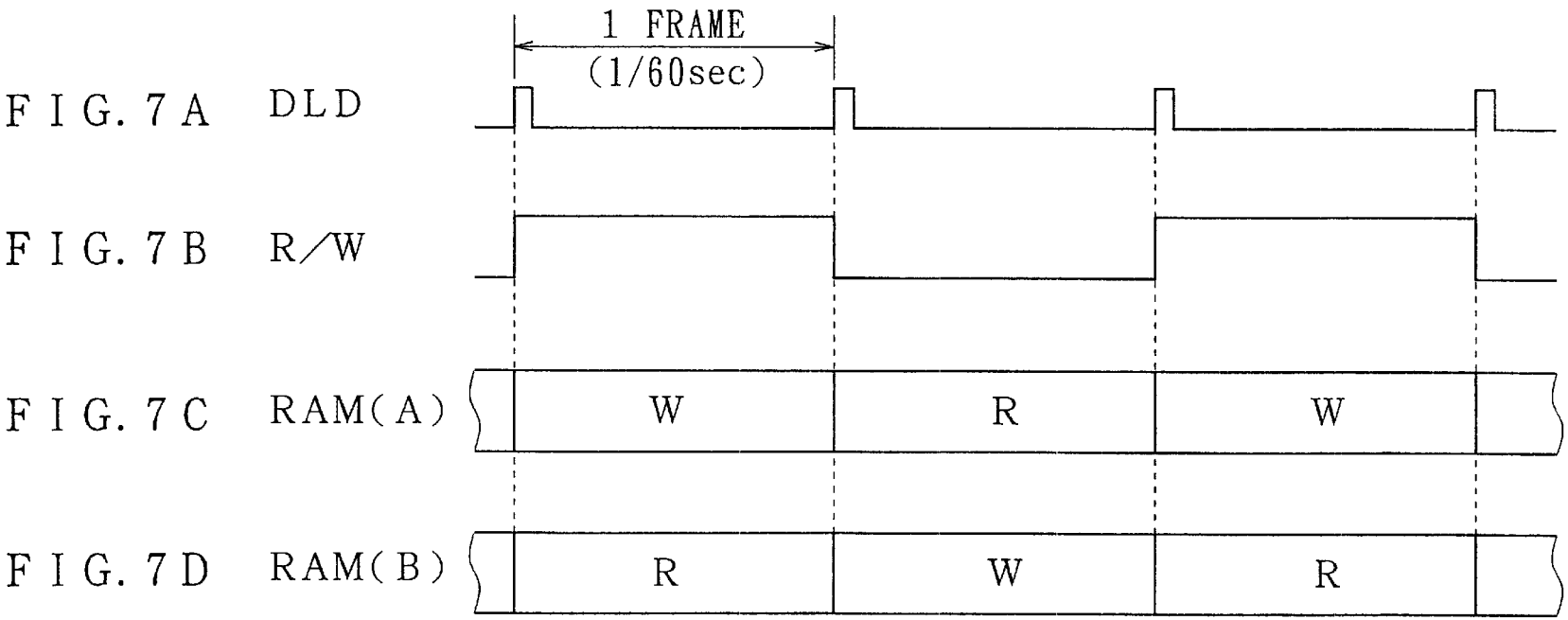
FIGS. 7A through 7D are respectively diagrams for describing timing provided to write data into a memory and read data therefrom.

The unit cell 18 is configured in 4×4 dots as shown in FIG. 2B. When an n row and an n+2 row of these dots are defined as a first dot group U and then an n+1 row and an n+3 row of thereof are defined as a second dot group L, these first and second dot groups U and L are alternately driven in a predetermined cycle. Thus, the number of drivers for driving each display element is reduced to half. In the embodiment of FIG. 6, a driver circuit 32 is made up of twenty four drivers (RGB trios×8 dots=twenty four) per a unit cell.

When an image is displayed, a video signal is processed as a 10-bit digital signal to allow representation of a 1024-step gradation (0 to 1023 steps) in the present embodiment.

FIG. 6 shows a signal processing device for the unit cell 18, which is provided as one for each unit cell. A plurality of these signal processing devices 30 are placed on the backside of the display unit 20.

Referring to FIG. 6, video data outputted from a video source 12 such as a VTR or the like is supplied to a pair of memories 41 and 42 constituting first memory means, where video data corresponding to one frame is stored therein. That is, video data (=8 dots×2) corresponding to the unit cell 18 constituting the two dot groups U and L is stored in each of the memories 41 and 42. When one is defined as a memory (provided in a RAM configuration, for example) 41 for an odd frame, then the other is taken as a memory (RAM configuration, for example) 42 for an even frame.

Thus, as shown in FIGS. 7A through 7D, a read/write pulse (enable pulse) R/W is generated with a pulse DLD having a frame cycle as the reference (see FIGS. 2A and 2B). Consequently, a read/write process is alternately effected on the memories 41 and 42. Thus, when one memory (RAM A) 41 is kept in a write mode, the other memory (RAM B) is controlled to a read mode.

A data read counter 43 for controlling these memories 41 and 42 is provided. In addition to a basic clock CK, a data read pulse LDa (see FIG. 11A) having a frame cycle is supplied to the counter 43 from which a read/write pulse R/W is generated. In addition to the read/write pulse R/W, a carry pulse Pa and a read/write address ADR for the memories 41 and 42, and so forth, which will be described later, are outputted from the counter 43.

Figures 11A, 11B, 11C, 11D, 11E, 11F:
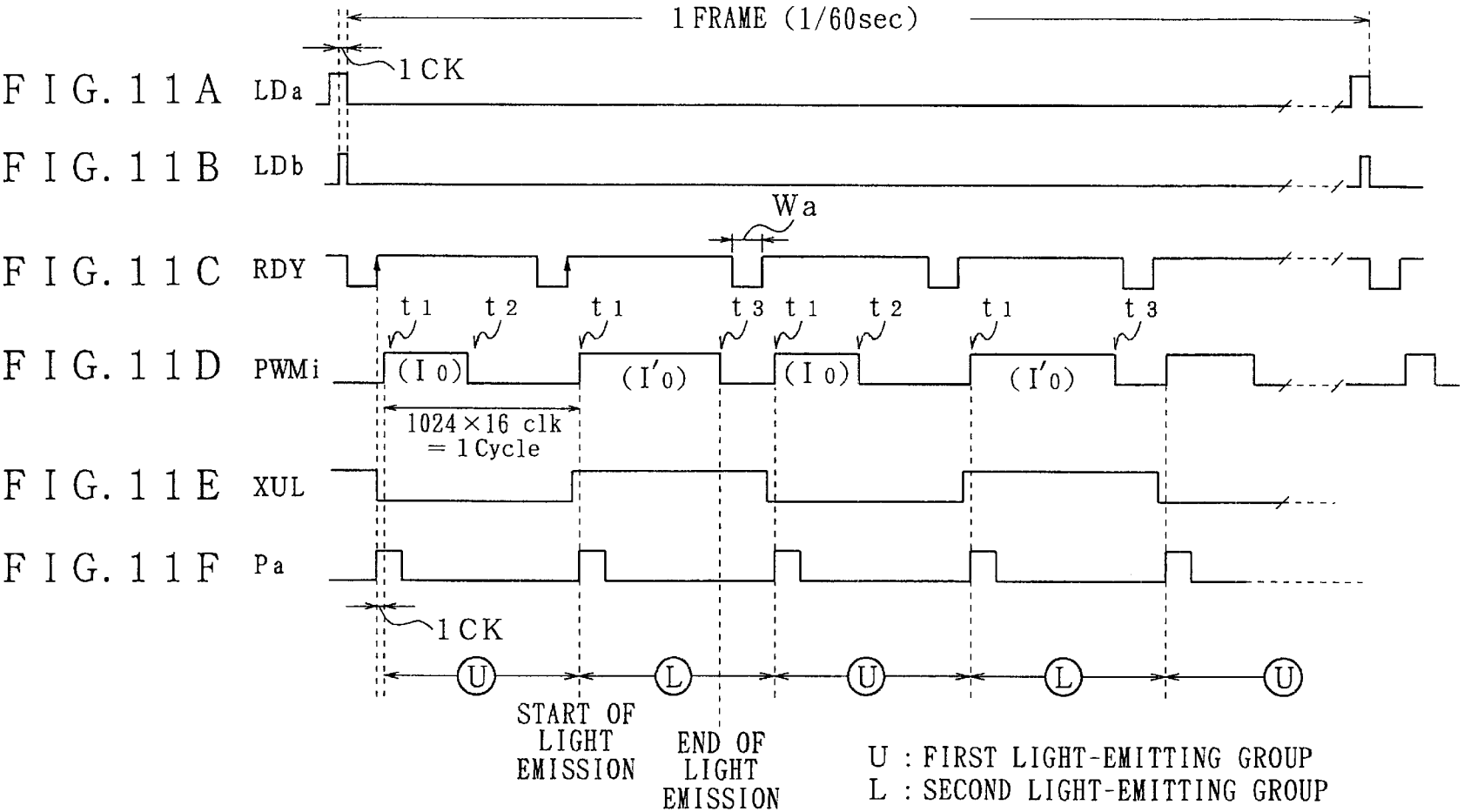
FIGS. 11A through 11F are respectively timing charts for describing a video display.

In the preferred case, each of video-data read and write periods or cycles may correspond to a period during which a ready pulse RDY synchronized with a synchronizing pulse LDb shown in FIG. 11B is kept low in level.

In the read mode, video data having a 10-bit width, which is read from each of the memories 41 and 42, is supplied to a shift register 44 including a latch circuit provided at a subsequent stage. The latch circuit latches video data corresponding to twenty four display elements constituting one dot group by using 24 clocks CK.

The following comparator 45 converts the video data given in this 10-bit representation into a compared output PWMi taken as video data (10-bit value) subjected to pulse width modulation. For this conversion, the carry pulse Pa and the clock CK are necessary to be supplied to a control signal generating circuit 50 (see FIGS. 8 and 11F). The control signal generating circuit 50 generates a counter output CO and transmits it to the comparator 45.

The control signal generating circuit 50 comprises a plurality of counters 51 through 54 as shown in FIG. 8. The first counter 51 receives the carry pulse Pa and the clock CK so as to generate a counter output CO synchronized with a clock CK as shown in FIGS. 9A and 9B. Further, the control signal generating circuit 50 is provided with the second counter 52, which in turn counts a carry pulse CP thereby to generate a switching pulse XUL (see FIG. 11E) for alternately driving the dot groups U and L. Moreover, the control signal generating circuit 50 is provided with third and fourth counters 53 and 54. The third counter 53 generates respectively pulses XR, XG and XB for driving RGB trios, to be described later, in dot sequence. Further, the fourth counter 54 generates a switching pulse XUL' or the like for switching the dot groups U and L, used when driven in dot sequence.

Further, a 4-bit configured brightness level control signal BRT for controlling a brightness level is supplied to the first counter 51. The present brightness level is controlled manually to control a brightness level of the entire video display part 14 according to external light. In the present embodiment, the brightness level can be controlled over sixteen steps.

The brightness level is controlled according to the length of the cycle of the pulse width. For example, when the brightness level is controlled to a high brightness level state as shown in FIG. 10A, a unit cycle Th is set longer. On the other hand, when the brightness level is controlled to a low brightness level state, a unit cycle T1 is set shorter as shown in FIG. 10B. Since the 4-bit control signal BRT is supplied as a factor for controlling the length of these cycles, the maximum value of one cycle reaches a 1024×24 clock width. The control signal BRT is externally supplied to the first memory 41.

The comparator 45 (FIG. 6) outputs a signal of a high level until 10-bit data of the latched video data and the count output CO coincide with each other. Thus, compared outputs PWMi shown in FIG. 11D, which differ in pulse width, are obtained according to the 10-bit value. The compared outputs PWMi each produced by converting 10-bit data into the length of the pulse width are obtained by the number of display elements (corresponding to 24 in the illustrated example). Each display element is driven by a time interval equivalent to the pulse width.

Now, the display elements are different from each other in luminous or light-emission brightness level even if the same current is passed thereto. In other words, they vary individually. In order to accommodate or correct variations in the individual display elements inclusive of luminescent colors, correction data, i.e., a current correction value for each individual display element is supplied from the outside. For this reason, current-correcting memory means (RAM or the like) 60 (FIG. 6) is provided as a second memory means. The memory means 60 stores current correction data (given a 10-bit configuration) corresponding to forty eight display elements, which is prepared in advance and supplied from the outside together with video data. The current correction data is also stored therein so as to correspond to the dot group. The current correction data is supplied to a shift register 61 including a latch circuit, where current correction data corresponding to twenty four display elements constituting one dot group are latched therein.

The current correction data is updated upon replacement of each unit cell by another and upon its re-adjustment. The memory means 60 is provided to allow the data to be externally set again as current correction data relative to each replaced and re-adjusted unit cell even when the unit cell 18 is replaced by another or re-adjusted as described above.

These current correction data is supplied to a D/A converter 62 where they are converted to twenty four analog corrected current values I0, I1, I2, . . . I23 respectively. These corrected current values are supplied to their corresponding drivers 34*a* through 34*x*. The drivers 34*a* through 34*x* are respectively supplied with the above-described compared outputs PWMi. Only when they are kept high in level, the drivers are constructed so as to operate.

A selector means (switching means) 35 is provided between the drivers 34*a* through 34*x* and the display elements. As described in the relevant example, the selector means 35 is used to allow display elements (e.g., set of display elements RU0 and RL0, . . . and so forth) provided at upper and lower stages to be alternately driven by the single drivers (34*a*, 34*b*, . . . 34*x*) in order to reduce the number of the drivers to one-half.

Figure 12:
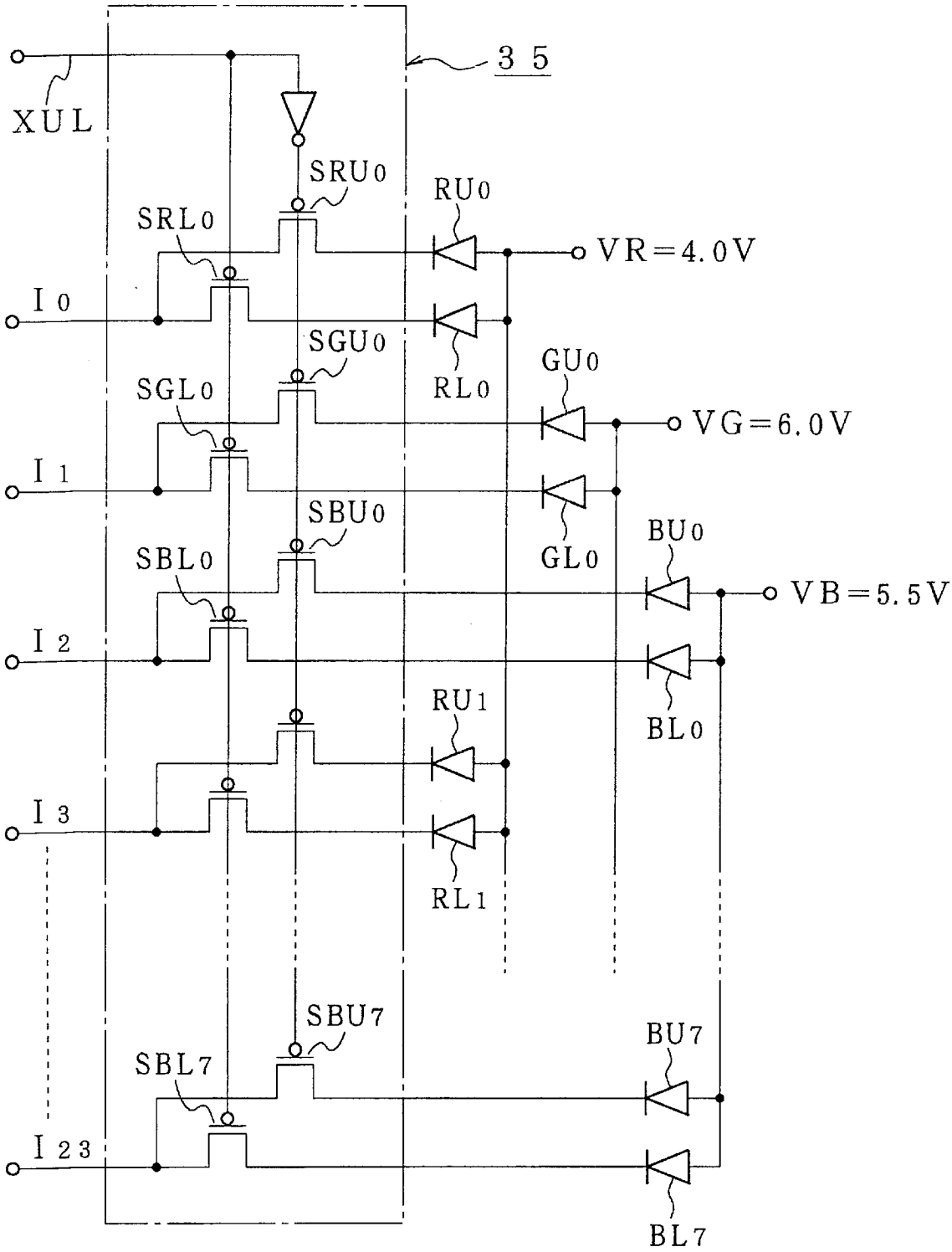
FIG. 12 is a diagram illustrating a configuration of a switching circuit.
Figure 13:
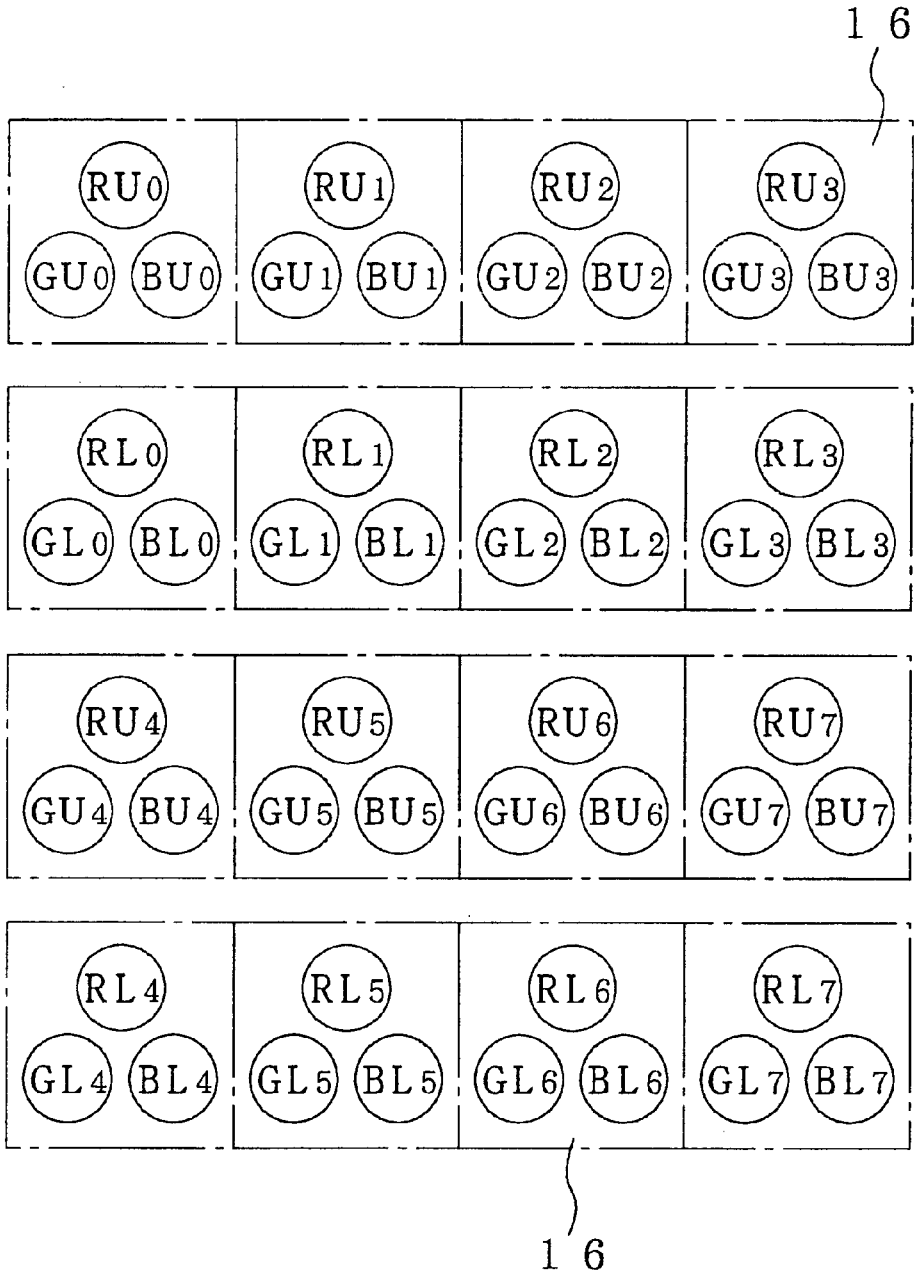
FIG. 13 is a diagram showing RGB trios and a unit cell configuration.

FIG. 12 shows a specific example of the selector means 35. In the present example, MOS transistors are used as semiconductor switching devices to switch between driver outputs. In other words, as is also apparent from FIG. 13, the first display element group U is made up of eight red light emitting display elements RU0 through RU3 and RU4 through RU7, eight green light emitting display elements GU0 through GU3 and GU4 through GU7, and eight blue light emitting display elements BU0 through BU3 and BU4 through BU7.

Similarly, the second display element group L comprises eight red light emitting display elements RL0 through RL3 and RL4 through RL7, eight green light emitting display elements GL0 through GL3 and GL4 through GL7, and eight blue light emitting display elements BL0 through BL3 and BL4 through BL7.

These display element groups U and L are alternately driven using their corresponding video data (i.e., same data with respect to the same color) during one frame to display an image or picture.

In order to implement the invention, the driver 34*a* (FIG. 6) is commonly connected (best seen in FIG. 12) to the display element RU0 constituting the first display element group U via a transistor SRU0 and the display element RL0 constituting the second display element group L via a transistor SRL0, respectively.

The transistors SRU0 and SRL0 are switched by the switching signal XUL. Thus, when the transistor SRU0 is turned on, the display element RU0 is time-divisionally driven by a first drive current I0 (one subjected to a current correction) based on video data SO corresponding to the display element RU0 as shown in FIGS. 11D and 11E. Next, when the other transistor SLU0 is turned on, the display element RL0 is time-divisionally driven by a first drive current I0' (one subjected to a current correction) based on video data S0' corresponding to the display element RL0. Other display elements are also constructed in the same manner as described above. Using the switching signal XUL, switching is performed between the corresponding display elements GU1, GL1, . . . BU7, BL7.

Since only processes for reading video data from the memories 41 and 42 and shifting them, and latching the same are performed here within the same frame as a process for shifting video data and a process for latching the data, these processes can be executed within a very short period or cycle Wa shown in FIG. 11C in either case. As a result, even when the switching signal XUL is short in cycle, no trouble occurs when the video data is taken in or captured, and the display elements can be time-divisionally driven while being switched at high speed by the switching signal XUL. Consequently, video flicker can be prevented from occurring.

In order to correct variations in the brightness level of each individual display element, such current correction data as to take the same brightness level is stored for each display element. Further, the display elements are driven based on the current correction data when driven. As a result, variations in brightness level within each unit cell as well as variations in the brightness level of the entire video display part 14 comprised of the plurality of display units 20 can be corrected.

Figure 14:
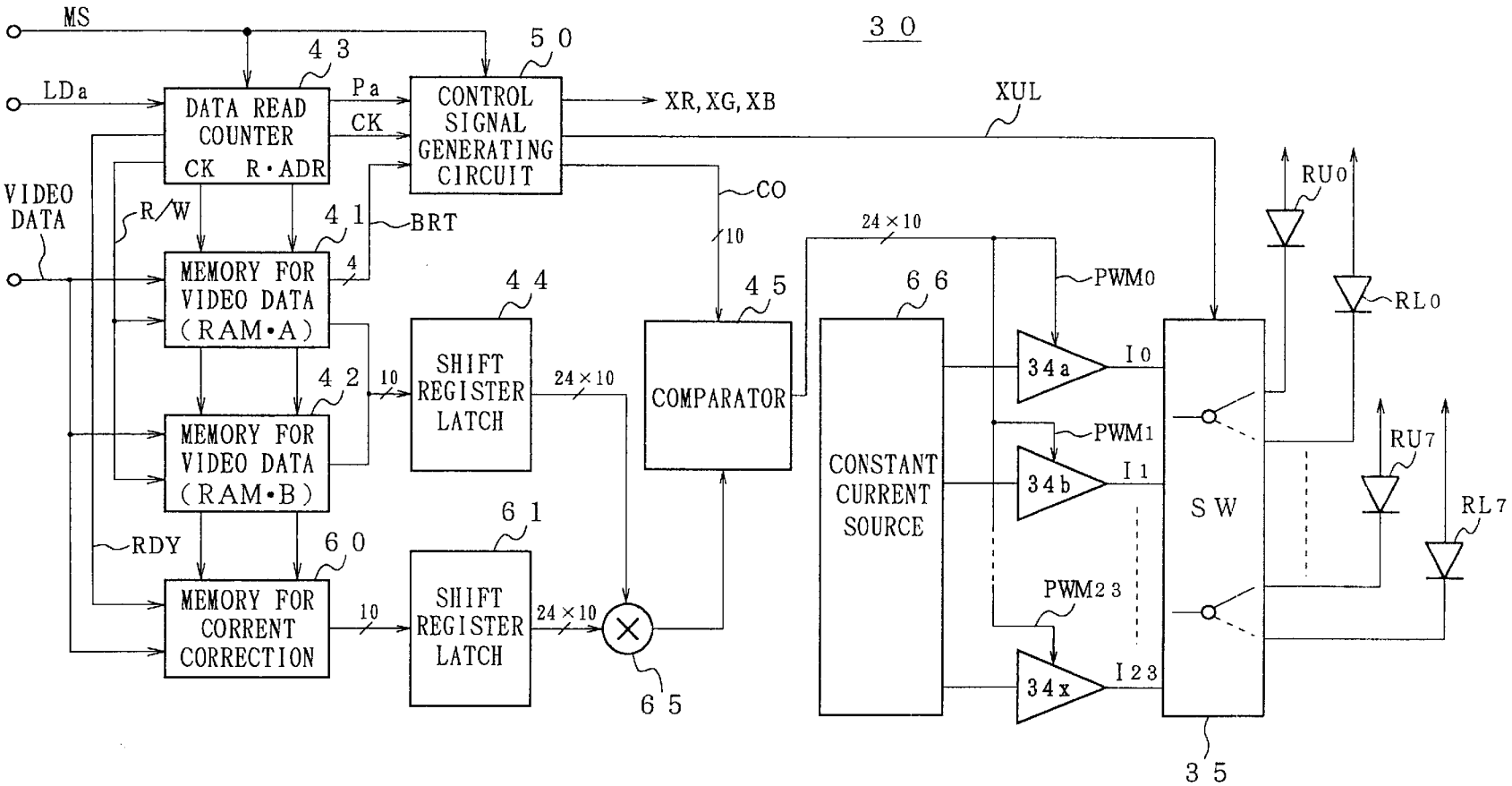
FIG. 14 is a fragmentary systematic diagram depicting a signal processing device for a unit cell, which constitutes a video display device as a second embodiment of the present invention.

FIG. 14 and later drawings show other embodiments according to the present invention.

While the drive current values different from each other, all of the display elements are subjected to D/A conversion and the resultant respective data is supplied to their corresponding drivers in the configuration shown in FIG. 6, FIG. 14 illustrates a modification of the signal processing device as shown in FIG. 6.

The modification of FIG. 14 is the same as that shown in FIG. 6 up to a process for reading current correction values from the memory means 60 and shifting the same by twenty four, and latching them. Each latched current correction value is supplied to a multiplier 65 together with latched video data, where the video data itself is weighted by the current correction value. Thus, the contents of 10-bit video data are changed according to each current correction value. The weighted video data is converted to a pulse width by a comparator 45.

On the other hand, all the drivers 34*a* through 34*x* are electrically connected to a constant current source 66. Operating periods or cycles of the drivers 34*a* through 34*x* are controlled by weighted compared outputs PWMi. Even in the case of such a construction, it is possible to accommodate variations in each individual display element, and thereby allow a luminous display.

The embodiments of FIGS. 6 and 14 have described the sequential drive system for alternately driving the display elements identical in color, of the first and second display element groups in the cycle of the switching signal XUL and driving the display elements of the same color simultaneously. Even in the case of a dot sequential drive system for successively light-emitting RGB trios in the dot as opposed to this sequential drive system, an image can be displayed.

Figures 15A, 15B, 15C, 15D, 15E, 15F, 15G, 15H:
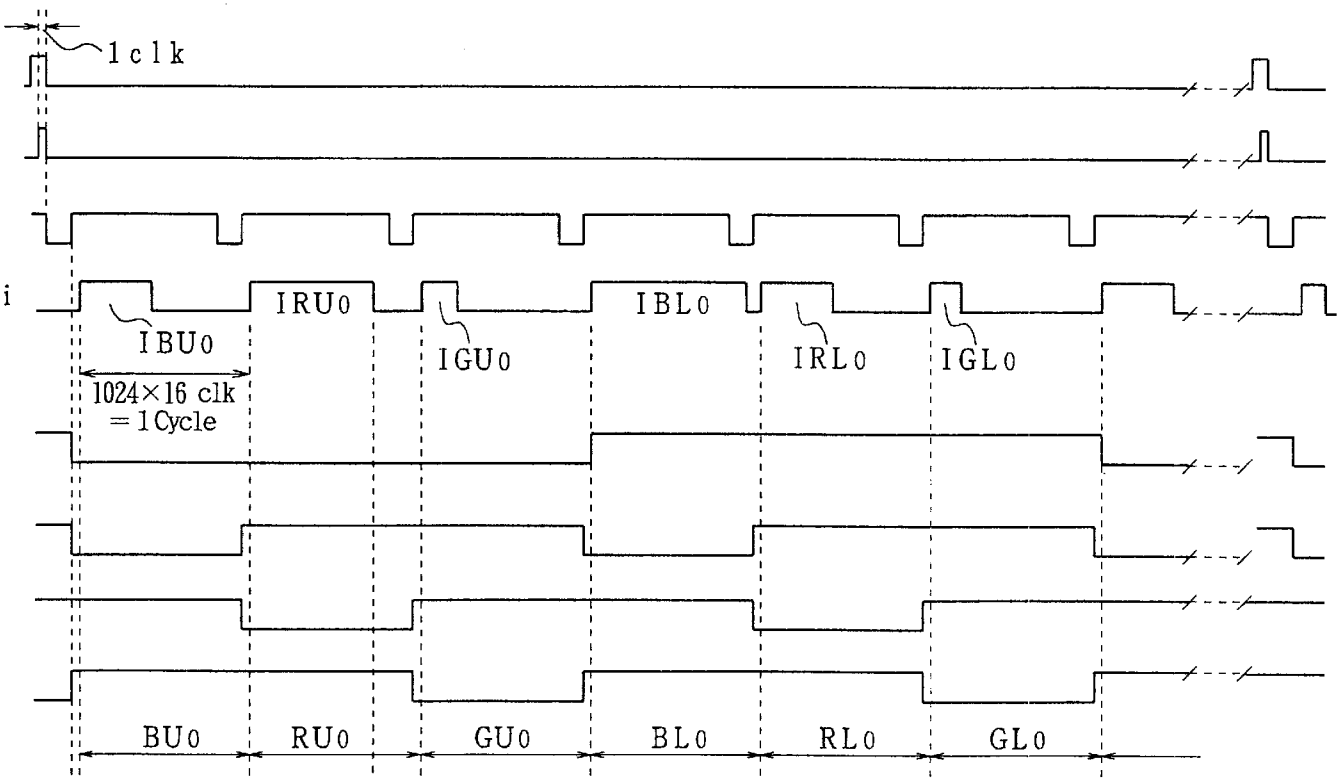
FIGS. 15A through 15H are respectively timing charts for describing a video display in FIG. 13.

In this case, for example, a dot located at an upper stage and a dot located at a lower stage, of dots positioned in the same column are driven as pairs. This will be described with reference to FIGS. 15A through 15H. In the dot configuration shown in FIG. 13, for example, a RGB trio (RU0, GU0 and BU0) located at an upper stage, of RGB trios constituting a pair of vertically-positioned dots is first driven on a dot-sequential basis. In the next cycle, a RGB trio (RL0, GL0 and BL0) located at a lower stage is driven on a dot-sequential basis (see FIG. 15D). The remaining pairs are also driven on the similar dot-sequential basis. For example, the RGB trio (RU0, GU3 and BU3) located at the upper stage and the RGB trio (RL3, GL3 and BL3) located at the lower stage are driven as a pair on the dot-sequential basis. This is repeated within one frame. Capturing video data is performed within a cycle or period Wa in which a ready pulse RDY is kept low in level, in a manner similar to FIG. 6.

Figure 16:
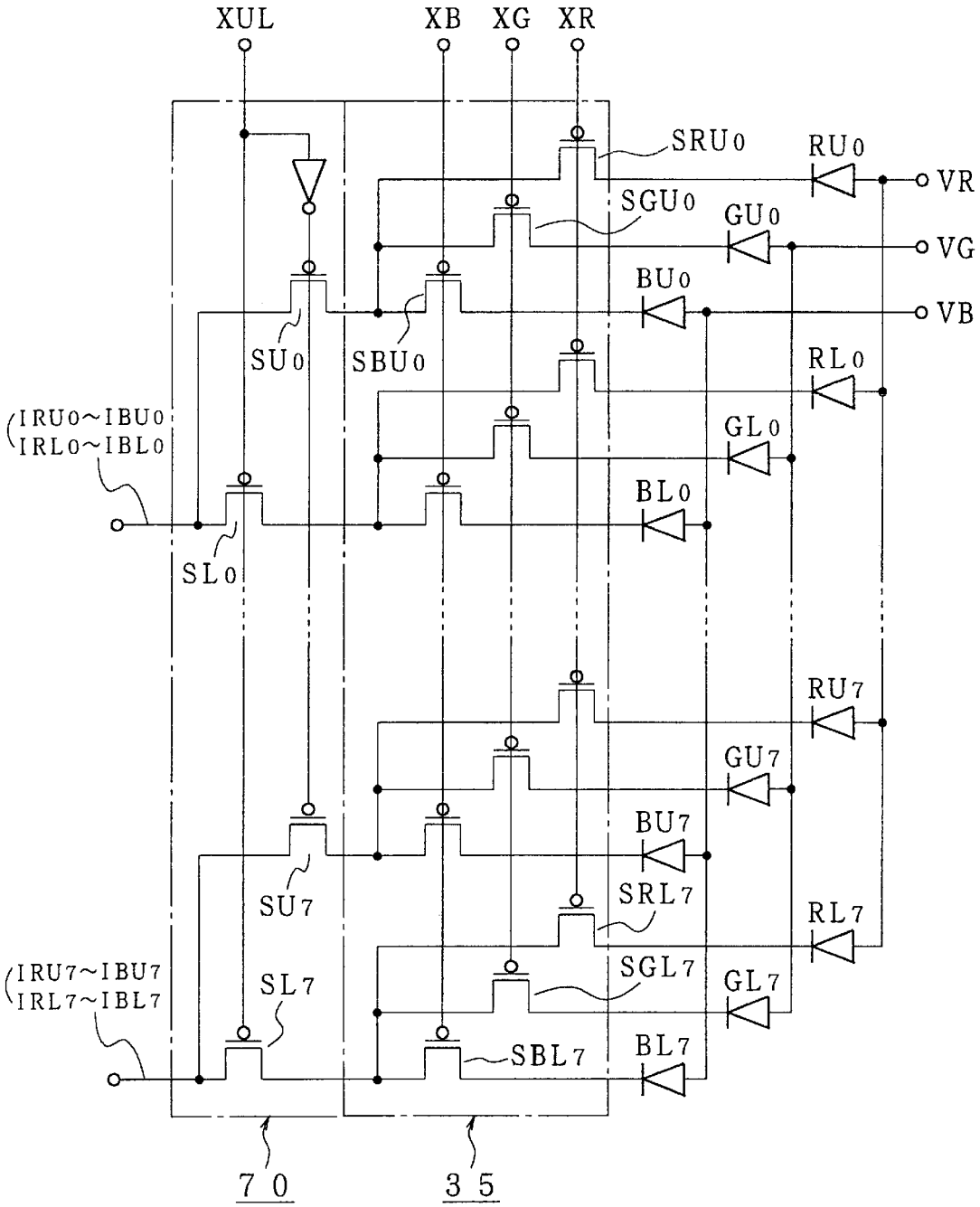
FIG. 16 is a connection diagram of a switching circuit shown in FIG. 14.
Figures 17A, 17B, 17C, 17D, 17E, 17F, 17G, 17H, 17I:
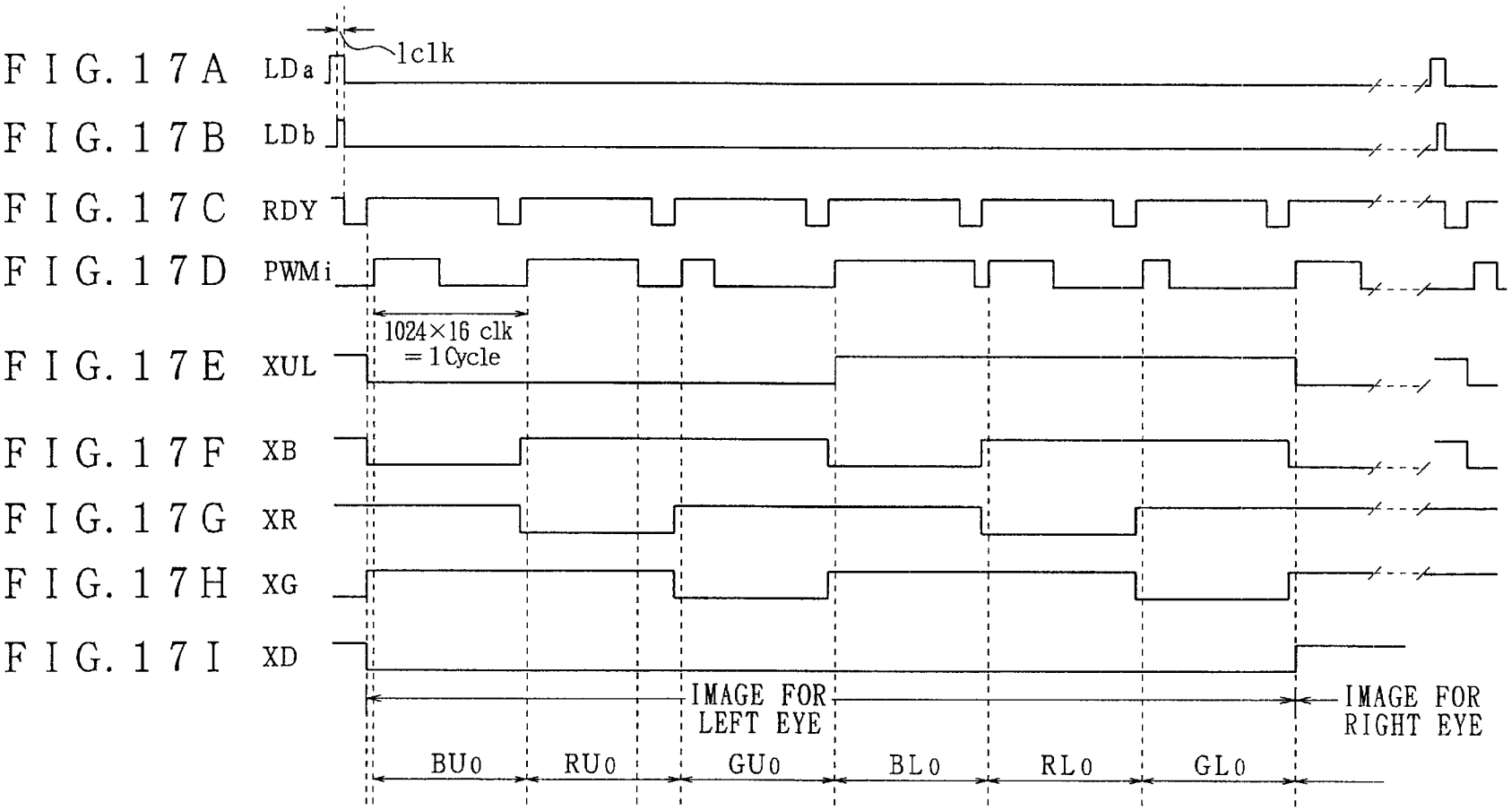
FIGS. 17A through 17I are respectively timing charts at a stereoscopic video display.

In order to perform this processing, first and second switching means 35 and 70 are respectively provided as shown in FIG. 16. Three switching elements (SRU0, SGU0 and SBU0), (SRU1, SGU1 and SBU1), . . . (SRU7, SGU7 and SBU7) with respect to respective dots are used for the first switching means 35. They are commonly supplied with switching signals XR, XG and XB shown in FIG. 15 respectively.

The second switching means 70 comprised of pairs of switching elements (SU0 and SL0), (SU1 and SL1) , . . . (SU7 and SL7) is provided to select their dots 16. The switching elements are alternately changed by a switching signal XUL' (see FIG. 8 and FIGS. 15A through 15H).

Further, drive currents IRU0 through IBU0 based on video data for the RGB trio provided at the upper stage, and drive currents IRL0 through IBL0 based on video data for the RGB trio provided at the lower stage are supplied to these switching means 35 and 70 as common driver outputs. Owing to this construction, the upper and lower RGB trios can be driven by the same driver as each pair.

That is, since six display elements can be driven go by one driver owing to such a construction, the number of drivers can be further reduced as compared with the configuration shown in FIG. 6 or the like.

An embodiment shown in FIGS. 17A through 17I shows a further modification of FIG. 14. The present embodiment shows a construction in which a three-dimensional or stereoscopic image can be implemented. In this case, video data for the left eye and video data for the right eye are necessary. Therefore, the video data for these left and right eyes are respectively stored in the same memories 41 and 42 as video data corresponding to one frame. Thus, the capacity of each memory needs twice that employed in FIG. 6.

When the RGB trios are driven on the dot-sequential basis, the video data for the left eye is first read with a cycle for driving upper and lower dots as a unit as shown in FIGS. 17A through 17I and its corresponding display elements are driven. In the next cycle, the video data for the right eye is read and its corresponding display elements are driven. This is repeated several times within one frame. A person who looks at or views an image or picture, uses stereoscopic spectacles. With respect to the stereoscopic spectacles, their shutters for the left and right eyes are alternately opened and closed in synchronism with the left and right video data shown in FIG. 17. When an image for the left eye is projected, for example, the shutter for the left eye may be opened.

Thus, a stereoscopic image can be enjoyed without any video flicker. Its construction is also simple.

In the preferred embodiments of the present invention as have been described above, video data is stored in memory means, and when a video display part comprises a plurality of display elements, correction data for correcting variations in luminous brightness of each display element is stored in another memory means. The display elements are driven using the correction data when driven.

According to these embodiments of the invention, variations in luminous brightness of the entire video display part with respect to video data read at high speed can be reliably corrected. Further, even when a unit cell is replaced by another and its brightness level is readjusted, new correction data relative to them may simply be stored in another memory means. Thus, the variations in the luminous brightness can be corrected with great facility.

Accordingly, the present invention is extremely suitable for application to a large video display device or the like comprised of a large number of display units as described above.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A video display device comprising a display unit including a unit cell, said unit cell comprising:

a plurality of dots arranged vertically and horizontally, each dot being comprised of a plurality of display elements;

first memory means for storing therein video data to be supplied to said display elements; and second memory means for storing therein current correction data for correcting variations in luminous brightness of each of said display elements, thereby allowing said current correction data to be reset even when said unit cell is being replaced or readjusted;

a data read counter connected to both the first and second memory means;

wherein said display elements are driven based on the current correction data read from said second memory means.

2. The video display device according to claim 1, wherein said dot comprises three display elements, each display element emitting light of red, green or blue.

3. The video display device according to claim 1, wherein said display element comprises any of an organic light-emitting device, a light-emitting diode device, a discharge tube and a cathode ray tube.

4. The video display device according to claim 1, wherein said display element is driven on the basis of current values corresponding to analog values for the correction data read from said second memory means.

5. The video display device according to claim 1, wherein said video data to be corrected is a digital value, said video data is corrected by the correction data read from said second memory means, and each of said display elements is driven on the basis of the video data corrected.

6. The video display device according to claim 5, wherein said video data corrected is pulse-width modulated and the time required to drive said display element is controlled on the basis of the pulse width.

7. The video display device according to claim 1, wherein said first memory means comprises a plurality of storing means each of which stores successively the video data to be supplied to said plurality of display elements in either one-frame unit or one-field unit.

8. The video display device according to claim 7, wherein said first memory means comprises two memories, one of which stores therein the video data corresponding to one odd-numbered frame or field and the other of which stores therein the video data corresponding to one even-numbered frame or field.

9. The video display device according to claim 1, wherein said first memory means stores therein the video data to be supplied to said plurality of display elements in one-frame unit or one-field unit, and when said dots are divided into a plurality of dot groups, said dot groups are successively switched and driven on the basis of the video data read from said first memory means, said video data corresponding to said dot groups.

10. The video display device according to claim 9, wherein said dot groups comprises two dot groups and said two dot groups are alternately switched and driven on the basis of video data read from said first memory means, said video data corresponding to said two dot groups.

11. The video display device according to claim 9, wherein said dot comprises three display elements, each display element emitting light of red, green or blue; and wherein said dot groups are comprised of display elements emitting the same light-emitting color and driven successively and simultaneously for each of said dot groups.

12. The video display device according to claim 9, wherein said dot comprises three display elements as a unit, said elements emitting respectively light of red, green and blue; and wherein said three display elements are successively switched and driven according to the switching of said dot groups.

13. The video display device according to claim 1, wherein said video data is video data for a stereoscopic display.

14. The video display device according to claim 13, wherein video data for the left eye and video data for the right eye are alternately read from the first memory means within the same frame cycle.

15. The video display device of claim 1, further comprising:

while one of said memory means is kept in write mode, the other is kept in read mode.

16. The video display device of claim 1, further comprising:

a shift register, connected to both first and second memory means;

a following comparator, connected to the shift register, a control signal generating circuit, connected to said following comparator as well as the clock and carry pulses;

wherein the following comparator converts the video data into a compared output to be pulse-width modulated by the control signal generating circuit.

17. The video display device of claim 16, wherein said control signal generating circuit further comprises:

a first counter which receives the carry pulse and clock pulse so as to generate a synchronized counter output;

a second counter which receives a switching pulse and thereby generates a carry pulse;

a third counter which generates pulses which drive red, greed, and blue triads; and a fourth counter which generates a pulse for switching between upper and lower dot groups.

18. The video display device of claim 16, wherein said comparator outputs a high level signal until latched video data and a count output coincide with each other, thereby producing compared outputs which differ in pulse width.

19. The video display device of claim 1, wherein said second memory means stores predetermined current correction data corresponding to a plurality of display elements, so that said data can be reset even when said unit cell is being replaced or readjusted.

20. The video display device of claim 17, further comprising:

a selector means, responsive to said fourth counter pulse, for allowing both upper and lower display elements to be alternatively driven by a single driver.

* * * * *